US011268325B2

(12) United States Patent
Alharbi

(10) Patent No.: US 11,268,325 B2
(45) Date of Patent: Mar. 8, 2022

(54) DIRECTIONAL DRILLING

(71) Applicant: Saudi Arabian Oil Company, Dhahran (SA)

(72) Inventor: Atallah N. Alharbi, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 16/836,349

(22) Filed: Mar. 31, 2020

(65) Prior Publication Data

US 2021/0301595 A1 Sep. 30, 2021

(51) Int. Cl.

| | |
|---|---|
| ***E21B 7/06*** | (2006.01) |
| ***E21B 4/02*** | (2006.01) |
| ***E21B 21/10*** | (2006.01) |
| ***E21B 44/00*** | (2006.01) |
| ***E21B 47/024*** | (2006.01) |

(52) U.S. Cl.

CPC ..... *E21B 7/062* (2013.01); *E21B 4/02* (2013.01); *E21B 7/068* (2013.01); *E21B 21/10* (2013.01); *E21B 44/00* (2013.01); *E21B 47/024* (2013.01)

(58) Field of Classification Search

CPC . E21B 7/062; E21B 7/068; E21B 4/02; E21B 21/10; E21B 44/00; E21B 47/024

See application file for complete search history.

(56) References Cited

U.S. PATENT DOCUMENTS

| | | | |
|---|---|---|---|
| 4,597,454 A | 7/1986 | Schoeffler | |
| 4,813,497 A | 3/1989 | Wenzel | |
| 6,176,327 B1 * | 1/2001 | Hearn | E21B 21/103 175/38 |
| 6,978,850 B2 | 12/2005 | Sawyer | |
| 7,510,031 B2 | 3/2009 | Russell et al. | |
| 9,777,540 B2 | 10/2017 | Downie et al. | |

(Continued)

FOREIGN PATENT DOCUMENTS

| | | |
|---|---|---|
| CN | 2386178 | 7/2000 |
| CN | 103015899 | 4/2013 |

(Continued)

OTHER PUBLICATIONS

PCT International Search Report and Written Opinion in International Appln. No. PCT/US2021/024851, dated Jun. 4, 2021, 13 pages.

*Primary Examiner* — Dany E Akakpo
(74) *Attorney, Agent, or Firm* — Fish & Richardson P.C.

(57) ABSTRACT

A drilling assembly that includes a drill string, a drill bit assembly, and a transmission sub disposed between the drill bit assembly and the drill string. The transmission sub includes a first tube attached to the drill string and a second tube rotationally coupled to a downhole end of the first tube. The second tube is coupled to the drill bit assembly. The transmission sub also includes a clutch assembly coupled to the first tube and has mechanical engagement features configured to simultaneously engage mechanical engagement features of the first tube and mechanical engagement features of the second tube to rotationally lock the first tube to the second tube. At least a portion of the clutch assembly moves along a longitudinal axis of the first tube to disengage the second mechanical engagement features of the second tube to rotationally unlock the first tube from the second tube.

18 Claims, 4 Drawing Sheets

(56) References Cited

U.S. PATENT DOCUMENTS

| | | | | |
|---|---|---|---|---|
| 2001/0052428 | A1* | 12/2001 | Larronde | E21B 7/062<br>175/61 |
| 2005/0211473 | A1* | 9/2005 | Zupanick | E21B 7/067<br>175/75 |
| 2009/0288885 | A1 | 11/2009 | Johnson | |
| 2011/0140411 | A1 | 6/2011 | Marchand | |
| 2018/0223599 | A1* | 8/2018 | Yang | E21B 7/067 |

FOREIGN PATENT DOCUMENTS

| | | |
|---|---|---|
| EP | 1201873 | 4/2005 |
| GB | 2483825 | 3/2012 |
| WO | 2012039630 | 3/2012 |
| WO | 2013136113 | 9/2013 |
| WO | 2018116140 | 6/2018 |

* cited by examiner

DIRECTIONAL DRILLING

FIELD OF THE DISCLOSURE

This disclosure relates to drilling wellbores, in particular, to methods and equipment used in directional or slide drilling.

BACKGROUND OF THE DISCLOSURE

Directional drilling refers to changing the direction of a wellbore during drilling. Directional drilling is used to drill non-vertical wellbores. Directional drilling tools can be used to drill complex wells such as directional wells, horizontal wells, extended reach wells, and multi-lateral wells. A common method of directional drilling is slide drilling, in which a bent motor oriented in a non-vertical direction drives the drill bit while the drill string remains rotationally fixed, sliding on the wall of the wellbore. Methods and equipment to improve slide drilling are sought.

SUMMARY

Implementations of the present disclosure include a drilling assembly that includes a drill string configured to be disposed in a wellbore, a drill bit assembly coupled to a downhole end of the drill string, and a transmission sub coupled to and disposed between the drill bit assembly and at least a portion of the drill string. The transmission sub includes a first tube attached to the drill string and includes first mechanical engagement features. The transmission sub also includes a second tube rotationally coupled to a downhole end of the first tube. The second tube is fluidically coupled to the first tube. The second tube includes a downhole end attached to one of 1) the drill bit assembly or 2) a section of the drill string attached to the drill bit assembly. The second tube includes second mechanical engagement features. The transmission sub also includes a clutch assembly coupled to the first tube and includes mechanical engagement features configured to simultaneously engage the first mechanical engagement features of the first tube and the second mechanical engagement features of the second tube to rotationally lock the first tube to the second tube. The clutch assembly engages the first tube and the second tube such that rotating the first tube rotates the second tube. At least a portion of the clutch assembly moves along a longitudinal axis of the first tube to disengage the second mechanical engagement features of the second tube to rotationally unlock the first tube from the second tube.

In some implementations, the clutch assembly comprises a sleeve configured to be disposed inside at least a portion of the first tube. The sleeve is movable in a direction parallel to the longitudinal axis to engage or disengage the second mechanical engagement features of the second tube. In some implementations, the clutch assembly includes an actuator system operationally coupled to the sleeve and configured to move, based on information sensed by sensors of the transmission sub, the sleeve to engage or disengage the second mechanical engagement features of the second tube. In some implementations, the mechanical engagement features of the clutch assembly has two sets of outwardly projecting teeth extending from an outer surface of the sleeve. The first mechanical engagement features of the first tube and the second mechanical engagement features of the second tube include inwardly projecting teeth. The two sets of teeth of the sleeve simultaneously engage the teeth of the first tube and the teeth of the second tube to prevent rotation of the second tube with respect to the first tube. In some implementations, the clutch assembly includes a cam guide configured to rotate the sleeve to align the teeth of the sleeve with gaps between the teeth of the first tube and teeth of the second tube to help the sleeve engage the first tube and second tube.

In some implementations, the drill bit assembly has a bent motor and a drill bit axially coupled to and configured to be driven by the bent motor. The bent motor is actuated by hydraulic power from a drilling fluid flown, by the drill string, through the transmission sub, to the drill bit assembly.

In some implementations, the first tube is rotationally coupled, through bearings, to the second tube. The transmission sub defines a fluid pathway extending from the first tube to the second tube across the bearings. In some implementations, the clutch assembly is coupled to the first tube and one of the clutch assembly and the second tube includes a shoulder and the other of the clutch assembly and the second tube includes a groove configured to receive and engage the shoulder such that pulling the first tube in an uphole direction applies an axial load on the shoulder and the groove to help prevent applying the axial load on the bearings. In some implementations, the drill string transmits, during directional drilling, string weight, through the bearings, to the drill bit assembly as the drill string is rotated independently from the drill bit assembly to prevent the drill string from sticking to the wellbore.

In some implementations, the transmission sub further includes multiple sensors that sense information representing parameters including at least one of a position of the transmission sub, revolutions per minute of the first tube and the second tube, azimuth of the drill bit, and toolface direction of the drill bit assembly. The sensors are communicatively coupled to a processor communicatively coupled to the clutch assembly. The processor is configured to control, based on information received from the sensors, the clutch assembly and other components of the transmission sub.

In some implementations, the transmission sub further includes a rotary assembly at least partially disposed inside the first tube and the second tube. The rotary assembly keeps a toolface of the drill bit assembly stationary. In some implementations, the rotary assembly includes a mud motor that has a shaft fixed to the second tube and is rotationally coupled to the first tube. The shaft is configured to rotate, based on information sensed by sensors of the transmission sub, the second tube to keep the toolface of the drill bit assembly stationary. In some implementations, the shaft rotates, based on the information sensed by sensors, the second tube to counter a reactive torque applied to a drill bit of the drill bit assembly during directional drilling. In some implementations, the rotary assembly further includes a valve system that controls a flow of drilling fluid to the mud motor and to the drill bit assembly. The valve system opens or closes, based on information sensed by sensors of the transmission sub, a fluid pathway to rotate the mud motor and other components of the drilling assembly.

In some implementations, the drilling assembly includes a measuring-while-drilling (MWD) system communicatively coupled to the transmission sub. The MWD system controls the transmission sub based on readings received by the MWD system from sensors of the transmission sub.

Implementations of the present disclosure include a drilling sub that includes a first tube attached to a drill string disposed in a wellbore, a second tube rotationally coupled to a downhole end of the first tube and fluidically coupled to the first tube. The second tube has a downhole end coupled to a drill bit assembly disposed at a downhole end of the drill string. The drilling sub also includes a clutch assembly that has engagement features that simultaneously engage the first tube and the second tube to rotationally lock the first tube to the second tube such that rotating the first tube rotates the second tube. The clutch assembly moves along a longitudinal axis of the first tube to disengage the second tube to rotationally unlock the first tube from the second tube.

In some implementations, the clutch assembly comprises a sleeve configured to be disposed inside at least a portion of the first tube. The sleeve has mechanical engagement features and is movable along an interior surface of the first tube in a direction parallel to the longitudinal axis to engage or disengage mechanical engagement features of the first tube and second tube. In some implementations, the clutch assembly is configured to allow, with the clutch assembly engaged, rotary drilling with the drill string and the drill bit rotating simultaneously. The clutch assembly allows, with the clutch assembly disengaged, slide drilling with the drill string transmitting string weight to the drill bit assembly through the drilling sub as the drill string is rotated independently from the drill bit assembly, preventing the drill string from sticking to the wellbore.

Implementations of the present disclosure include a method of directional drilling. The method includes drilling, with a drilling assembly, a first portion of a wellbore. The drilling assembly includes 1) a drill string, 2) a drill bit assembly coupled to and residing at a downhole end of the drill string, and 3) a sub coupled to and disposed between the drill bit assembly and at least a portion of the drill string. The sub has a first tube attached to the drill string. The sub has a second tube rotationally coupled to the first tube and includes a downhole end coupled to the drill bit assembly. The sub has a clutch assembly that defines engagement features configured to simultaneously engage the first tube and the second tube to rotationally lock the second tube to the first tube such that rotating the first tube rotates the second tube. A portion of the clutch assembly moves along a longitudinal axis of the first tube and second tube to disengage the second tube to rotationally unlock the first tube from the second tube. Drilling the first portion of the wellbore includes drilling the first portion with the clutch assembly engaged to the first and second tubes such that rotating the drill string rotates the drill bit assembly. The method also includes disengaging the clutch assembly from the second tube of the sub to rotationally unlock the drill bit assembly from the drill string. The method also includes drilling, with the drill bit assembly rotationally unlocked from the drill string, a second, non-vertical portion of a wellbore. Drilling the second portion of the wellbore includes rotating the drill string to prevent the drill string from sticking to the wellbore.

In some implementations, disengaging the clutch assembly from the second tube includes actuating an actuator system of the clutch assembly to move a sleeve of the clutch assembly in an uphole direction parallel to the longitudinal axis of the first tube.

DETAILED DESCRIPTION OF THE DISCLOSURE

The present disclosure describes various tools and techniques that can be used for directional drilling. 'Directional drilling' is used herein to describe drilling a non-vertical wellbore or the building of an angle of deflection from a wellbore. Two methods used for directional drilling include 'slide drilling' (for example, oriented drilling) and drilling with a rotary steerable system (RSS) assembly. During 'slide drilling', the drill string is coupled to the drill bit such that rotating the drill string rotates the drill bit. During slide drilling, the drill bit is rotated by a downhole bent motor powered by the circulation of drilling fluid while the drill string is kept from rotating. The drill string remains rotationally stationary to keep the toolface of the drill bit in place. Because the drilling string is not rotated during slide drilling, the drill string can stick in the wellbore, causing undesirable delays. An RSS assembly includes expensive equipment that allows the deflection of the drill bit in the appropriate direction while still rotating the drill string. The present disclosure includes a drilling assembly with a transmission sub that can be used in a method similar to 'slide drilling'. The transmission sub rotationally locks and unlocks the drill string from the drill bit to allow the drill string to rotate the drill bit when locked and to rotate independently from the drill bit when unlocked.

Particular implementations of the subject matter described in this specification can be implemented so as to realize one or more of the following advantages. For example, the transmission sub of the present disclosure can allow continued rotation of a drill string during 'slide drilling'. The technology described in the present disclosure allows a drilling string to use a bent motor assembly (or another steerable motor or turbine) instead of using expensive RSS assemblies that can be prone to failure. Additionally, because the teeth-design of the transmission sub allows only two engagement modes (for example, locked or unlocked), the transmission sub can increase the durability and reliability of the drilling assembly. The technology described in the present disclosure can help reduce drag and allow better transmission of string weight to the drill bit, increasing the rate of penetration (ROP). Rotating the drilling string can help keep the wellbore clean and remove cuttings to help prevent the drill string from sticking in the wellbore. Rotating the drill string during directional drilling can also increase the life of the drill string. Additionally, rotating the drill string during directional drilling reduced the drag of the drill string, helping the drill string exit the milled window in extended reach wellbores or sidetrack in open hole portions of extended reach wellbores. The technology described in the present disclosure can also increase the ability to perform short-radius directional drilling.

Figure 1:
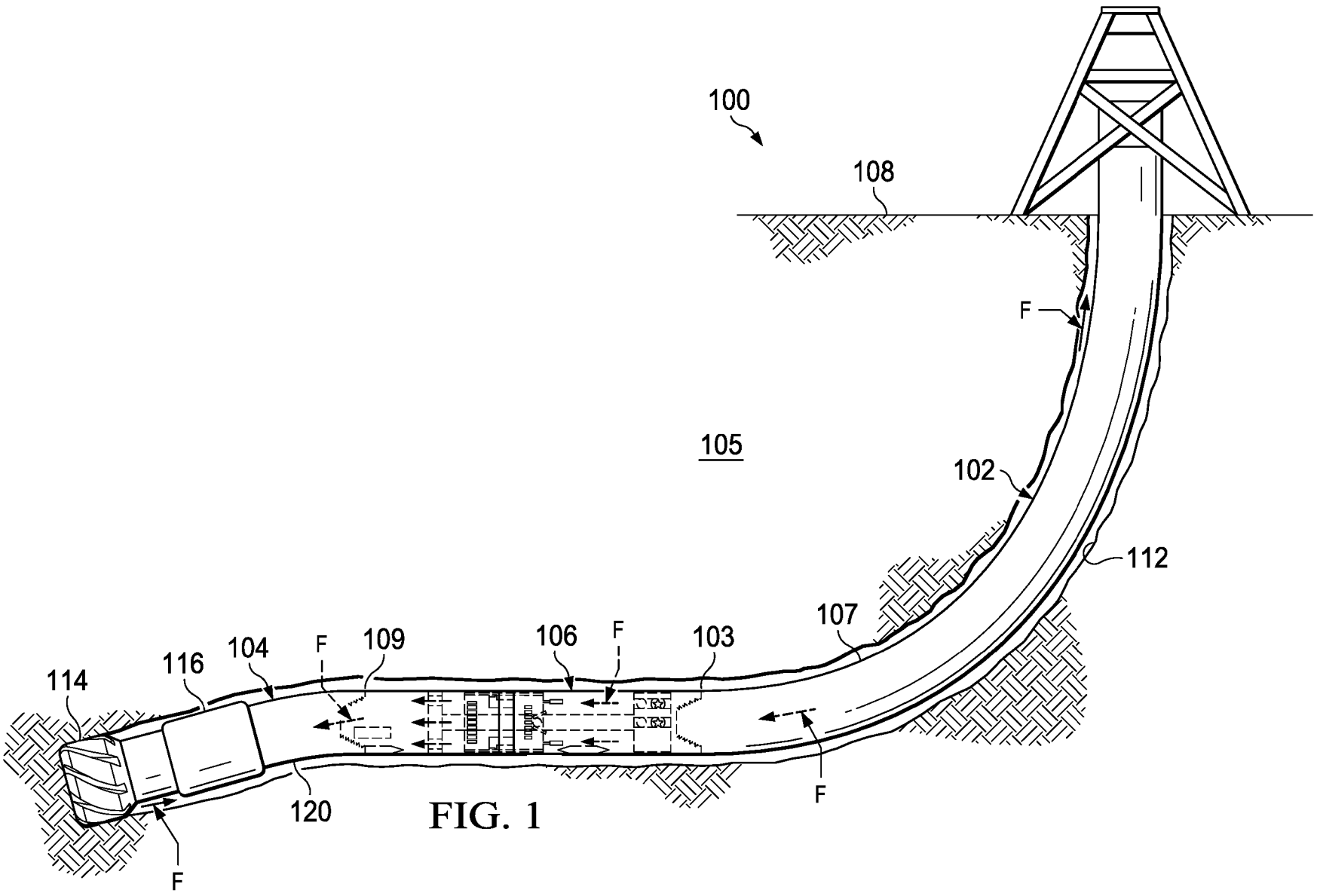
FIG. 1 is a side schematic view, partially cross sectional, of a drilling assembly according to implementations of the present disclosure.

FIG. 1 shows a drilling assembly 100 that includes a drill string 102 disposed in a wellbore 112, a drill bit assembly 104 coupled to a downhole end 103 of the drill string 102, and a transmission sub 106 coupled to and disposed between the drill bit assembly 104 and at least a portion 107 of the drill string 102. The wellbore 112 is formed in a geologic formation 105 that includes a hydrocarbon reservoir from which hydrocarbons can be extracted. The drill bit assembly 104 is directed (for example, from a surface 108 of the wellbore 112) to a desired location of the reservoir.

The drill bit assembly 104 includes a bent motor 116 and a drill bit 114 axially coupled to and driven by the bent motor 116. The bent motor 116 is actuated or rotated by hydraulic power from a drilling fluid 'F' (for example, drilling mud) flown, by the drill string 102, through the transmission sub 106, to the drill bit assembly 104. Specifically, the bent motor 116 converts the flow into rotational energy. The drilling fluid 'F' can also be used to cool and lubricate the drill bit and other components of the drilling assembly. The drilling fluid 'F' is flown downhole by the drill string 102 and exits the drilling assembly 100 through the drill bit 114. The drilling fluid 'F' is then flown through the annulus to the surface by a pump (not shown), where the fluid can be reused by the drill string 102.

The bent motor 116 is used to deflect or orient the drill bit 114 in a desired direction by rotating the drill string 102. For example, the bent motor 116 (for example, the housing of the bent motor) can be bent to a 1-2° angle, and the drill string 102 can be rotated to rotate the bent motor 116 and thus orient the drill bit 114. In some implementations, instead of the motor 116 being bent, a bent sub uphole of the motor 116 can be bent to help orient the drill bit 114 from the surface 108 along the planned direction for the well. The drill bit assembly 104 can include, instead of a bent motor 116, a mud turbine or a similar rotary assembly.

The transmission sub or drilling sub 106 can be attached to the downhole end 103 of the drill string 102 and to an uphole end 109 of the drill bit assembly 104. Alternatively, the transmission sub 106 can be disposed between two portions of the drill string 102 away from the drill bit assembly 104 (for example, disposed at a distance of 500 meters or more from the drill bit assembly 104). Thus, the transmission sub 106 can be attached either to the drill bit assembly 104 or to a section of the drill string 102 that is attached to the drill bit assembly 104.

The transmission sub 106 acts as a link between the drill bit assembly 104 and the drill string 102. As further described in detail later with respect to FIG. 2, the transmission sub can rotationally lock or rotationally unlock the drill bit assembly 104 from the drill string 102. The transmission sub 106 can transmit rotational motion from the drill string 102 to the drill bit assembly 104 during rotary drilling (for example, during vertical drilling). During rotary drilling, the drill string 102 can rotate the drill bit 114. The drill bit 114 can also be rotated (for example, in addition to being rotated by the drill string 102) by the bent motor 116.

Once the drilling assembly 100 is ready to begin directional drilling, the drill bit 114 is oriented and then the transmission sub 106 can rotationally unlock the drill string 102 from the drill bit assembly 104. For example, before drilling in a non-vertical direction, the drill string 102, still rotationally locked to the drill bit assembly 104, is rotated to orient the drill bit assembly 104 in a desired direction or angle, with the bent motor 116 changing the toolface of the drill bit 114 as the drill string 102 is rotated. With the drill bit assembly 104 oriented, the transmission sub 106 rotationally unlocks the drill bit assembly 104 from the drill string 102 to perform 'slide drilling', in which the drill bit 114 rotates independently from the drill string 102. With the drill string 102 rotationally disengaged or unlocked from the drill bit assembly 104, the drill string 102 can be rotated without changing the orientation of the drill bit assembly 104, allowing the drill string 102 to be rotated to help avoid the drill string 102 from sticking to the wellbore 112.

Figure 2:
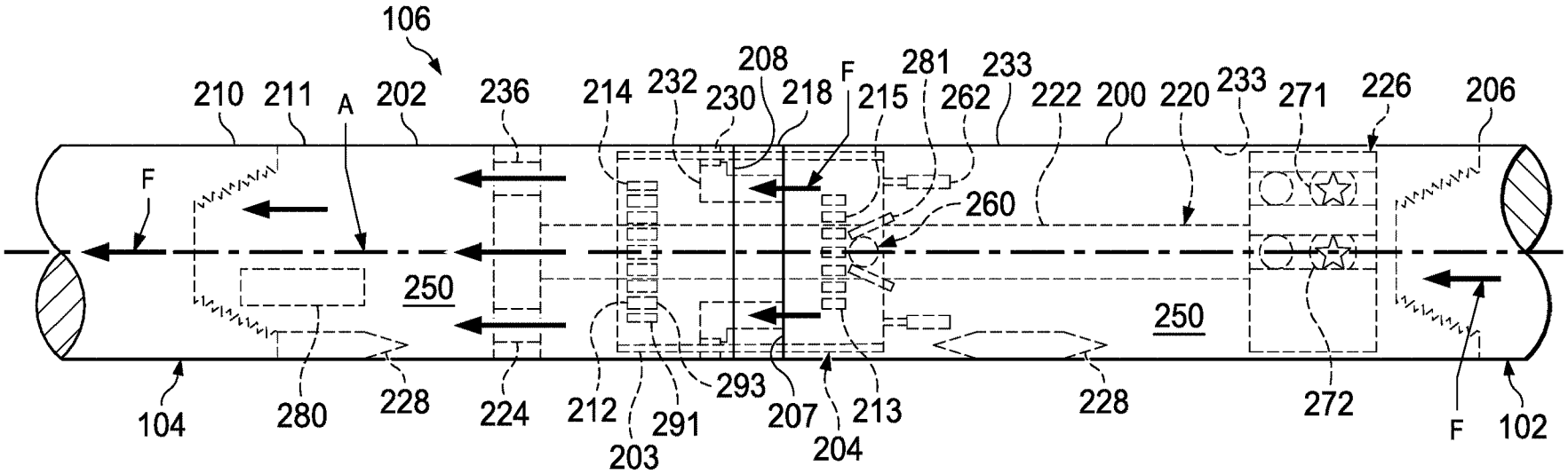
FIG. 2 is a side schematic view, partially cross sectional, of a transmission sub of the drilling assembly of FIG. 1.

FIG. 2 shows a detail view of the transmission sub 106 according to implementations of the present disclosure. The transmission sub 106 includes a first tube 200, a second tube 202 rotationally coupled (for example, capable of rotating with respect to the first tube 200) to the first tube 200, and a clutch assembly 204. An uphole end 206 of the first tube 200 is attached to the drill string 102. For example, the first tube 200 is threadedly connected to the drill string 102 such that rotating the drill string 102 rotates the first tube 200. A downhole end 207 of the first tube 200 is rotationally attached, through bearings 218, to an uphole end 208 of the second tube 202.

The second tube 202 is coupled to the drill bit assembly 104. For example, a downhole end 211 of the second tube 202 can be threadedly connected to an uphole end 210 of the drill bit assembly 104 or to an uphole end of a portion of the drill string that is attached to the drill bit assembly 104. The second tube 202 is fluidically coupled to the first tube 200.

The first tube 200 and second tube 202 are fluidically coupled to the drill string 102 and to the drill bit assembly 104. The first tube 200 and second tube 202 can house components of the transmission sub 106. For example, the transmission sub 106 can include a rotary assembly 220 (for example, a mud motor) disposed inside the first and second tubes 200 and 202. The rotary assembly 220 can include a mud motor shaft 222 coupled to the second tube 202. As further described in detail below, the rotary assembly 220 can help keep the toolface of the drill bit 114 in place. In implementations in which the transmission sub 106 does not include a rotary assembly 220, the transmission sub 106 can also keep the toolface in place by rotationally isolating, through the bearings 218, the drill string 102 form the drill bit assembly 104.

The clutch assembly 204 includes a clutch sleeve 203 disposed inside at least a portion of the first tube 200. The clutch assembly 204 also includes an actuator system 262 attached to the sleeve 203 and a cam guide 260 attached to the sleeve or to the first tube 200 to guide the motion of the sleeve 203. The sleeve 203 is movable along an interior surface 233 of the first tube 200 in a direction parallel to a longitudinal, central axis 'A' of the first tube 200 and second tube 202. The sleeve 203 moves to engage or disengage the first and second tubes 200 and 202 to rotationally lock or unlock the tubes, respectively. Specifically, the first tube 200 has mechanical engagement features 215 and the second tube 202 has mechanical engagement features 214 that the sleeve 203 engages or disengages as the sleeve 203 moves along the longitudinal axis 'A'. The sleeve 203 has mechanical engagement features 213 at one end and mechanical engagement features 213 at an opposite end to engage and disengage the mechanical engagement features of the tubes 200 and 202. The actuator system 262 can include a linear actuator that extends and retracts an arm attached to the sleeve 203 to move the sleeve.

The mechanical engagement features of the sleeve 203 and the tubes 200 and 202 can be teeth that nest with each other to prevent rotational motion. For example, the downhole mechanical engagement features 212 of the clutch assembly can be outwardly projecting teeth that extend from an outer surface of the sleeve 203. The uphole mechanical engagement features 213 of the clutch assembly can be outwardly projecting teeth or ribs that extend from the outer surface of the sleeve 203. The mechanical engagement features 215 of the first tube 200 and the mechanical engagement features 214 of the second tube 202 can be inwardly projecting teeth. The teeth of the sleeve 203 can simultaneously engage the teeth 215 and 214 of the first tube 200 and the second tube 202 to prevent rotation of the second tube 202 with respect to the first tube 200 and vise versa. The teeth can have a pointed tip 291 and 293 to help nest the teeth as the sleeve 203 moves to engage the teeth of the tubes 200 and 202 to engage with one another.

Still referring to FIG. 2, the sleeve 203 can simultaneously engage the first tube 200 and the second tube 202 to rotationally lock the first tube 200 to the second tube 202 such that rotating the first tube 200 rotates the second tube 202. The sleeve 203 moves along the longitudinal axis 'A' to disengage the second tube 202 to rotationally unlock the first tube 200 from the second tube 202. Thus, the clutch assembly 204 allows, with the sleeve 203 of the clutch assembly 204 engaged, rotary drilling in which the drill string 102 and the drill bit 114 rotate simultaneously. The clutch assembly 204 also allows, with the sleeve 203 disengaged, slide drilling in which the drill bit 114 rotates independently from the drill string 102. During slide drilling, the drill string 102 transmits string weight to the drill bit assembly 104 through the clutch assembly 106 as the drill string 102 is rotated independently from the drill bit assembly 104. Such rotation of the drill string 102 prevents the drill string 102 from sticking to the wellbore 112.

The actuator system 262 of the clutch assembly 204 is operationally coupled to the sleeve 203 to move the sleeve 203 to engage or disengage the mechanical engagement features 215 and 214 of the first tube 200 and the second tube 202. The actuator system 262 can be controlled from the surface 108 of the wellbore similar to other downhole tools. For example, the actuator system 262 can be controlled by a processor at the surface of the wellbore that sends information downhole (for example, using mud telemetry or a cable, or wireless communication) based on information received from the drilling assembly 100. Additionally, the actuator system 262 can be controlled by a processing device of the transmission sub 106.

The cam guide 260 of the clutch assembly 204 can include a circular extrusion extending from the exterior surface of the sleeve 203 that engages grooves (or ribs) 281 of the first tube 200. The grooves 281 apply side forces to rotate the sleeve 203 to mesh the teeth of the sleeve 203 with the teeth of the first tube 200 and second tube 202.

The first tube 200 is rotationally coupled, through bearings 218 (for example, ball bearings), to the second tube 202. The bearings 218 can be sealed or mud lubricated. The transmission sub 106 also includes extensions 232 (for example, steel extensions) that extend from first tube 200 into second tube 202 to engage the second tube 202 to take tensional forces to prevent the first tube 200 from separating from the second tube 202. For example, the extensions 232 hold the second tube 202 such that pulling the first tube 200 applies an axial load (and a shear load) on the extensions 232 to help prevent applying the axial load on the bearings 218. Thus, the drill string 102 can be retrieved from the wellbore without braking the bearing connection between the first tube 200 and the second tube 202. The steel extensions 232 can be hollow to flow fluid to the bearings 218 to lubricate the bearings 218. When no mud lubrication of the bearings 218 is necessary, the transmission sub 106 can also include seals 230 (for example, labyrinth seals such as elastomer or mechanical seals) that prevent mud from leaking to the bearings 218.

The transmission sub 106 defines a fluid pathway 250 or volume that extends from the first tube 200 to the second tube 202. The bearings 218 can be isolated from the fluid pathway 250 or fluidically coupled to the fluid pathway. The fluid pathway 250 extends through the bearings 218 and through the rotary assembly 220 to flow past the transmission sub 106 to the drill bit 114.

The rotary assembly or mud motor 220 of the transmission sub 106 is at least partially disposed inside the first tube 200 and the second tube 202. For example, the mud motor 220 includes a shaft 222 that extends from the first tube 200 to the second tube 202. The mud motor 220 helps keep a toolface of the drill bit assembly stationary when the first tube 200 is rotationally disengaged from the second tube 202 (for example, during directional drilling). The 'toolface' is referred herein as the toolface orientation or an angle measured in a plane perpendicular to a drill string axis (or a bent motor axis) that is between a reference direction on the drill string and a fixed reference.

The mud motor shaft 222 is fixed to an inner wall of the second tube 202 through a plate 224. The plate 224 has channels or holes 236 that allow the drilling fluid 'F' to flow past the plate 224. The mud motor shaft 222 is rotationally coupled, at an opposite end of the shaft 222, to an inner wall of the first tube 200 through a valve system 226. The shaft 222 is rotated by the drilling fluid 'F' to keep the toolface stationary while the drill string 102 (and the first tube 200) rotate. For example, the mud motor 220 serves as a contingency to keep the drill bit assembly 104 oriented in the desired direction when friction of the bearings 218 would otherwise slightly rotate the drill bit assembly 104 from the desired orientation. Also, vibration and reactive torque can change the toolface. The mud motor 220 can absorb the reactive torque to help prevent the drill string 102 from absorbing the reactive torque.

The mud motor shaft 222 can be controlled by a processing device 280 (or from the surface 108 of the wellbore 112) based on sensor data (for example, using a control loop) sensed by the transmission sub 106 to keep the toolface stationary. The mud motor shaft 222 rotates to constantly correct the toolface of the drill bit. The mud motor shaft 222 can be stationary when a first valve 271 is open to flow fluid to the drill bit (during rotary drilling with the clutch sleeve 203 engaged) and a second valve 272 is closed. The shaft 222 can rotate when the first valve 271 is closed and the second valve 272 is open to flow fluid that rotates the shaft 222. In some implementation, gears, a turbine, or electronic motors can be used instead of or in addition to the mud motor 220.

The valve system 226 controls a flow of the drilling fluid 'F' to the mud motor 220 and to the drill bit 114. As further described in detail below with respect to FIG. 4, the valve system 226 creates a differential pressure to rotate the mud motor 220.

The transmission sub 106 also includes multiple sensors 228 disposed inside the first tube 200 and second tube 202. The sensors 228 sense information representing parameters including at least one of a position of the transmission sub, revolutions per minute of the first tube 200 and the second tube 202, azimuth of the drill bit 114 (for example, at what direction is the drill bit 114 drilling), and toolface direction of the drill bit assembly. The sensors 228 are communicatively coupled to a processor 280 that controls the transmission sub 106. The processor 280 can be (or be part of) a measuring-while-drilling (MWD) system (or a wired drill pipe or a similar intelligent system). The MWD system controls the transmission sub 106 based on readings received by the MWD system from the sensors 228. The sensors 228 can be powered by and attached to the MWD system or have a separate power and data transmission system. The processor 280 is communicatively coupled to the clutch assembly 204 to control the clutch assembly 204 based on the information received from the sensors 228.

The MWD system can control, based on the information sensed by the sensors 228, the actuator system 262, the valve system 226, and other components of the transmission sub 106. For example, after the drill string 102 is rotated to orient the drill bit 114 and directional drilling begins, any undesired changes (for example, changes in direction due to friction, reactive torque or vibration) the MWD system can automatically correct the orientation of the drill bit 114 to the original orientation based on the information sensed by the sensors 228. The MWD system can correct the orientation in-situ, without sending the sensor data to the surface 108 of the wellbore 102.

Figure 3A:
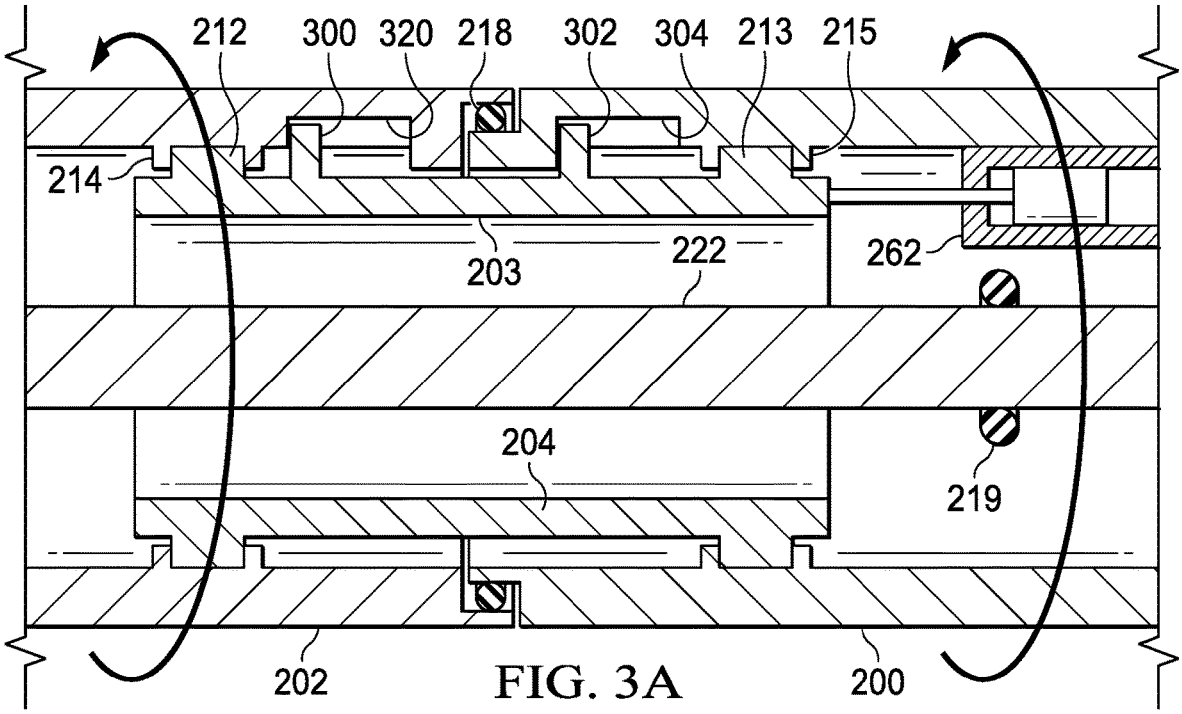
FIG. 3A is a side cross sectional view of a portion of the transmission sub of FIG. 2, with a clutch sleeve engaged.
Figure 3B:
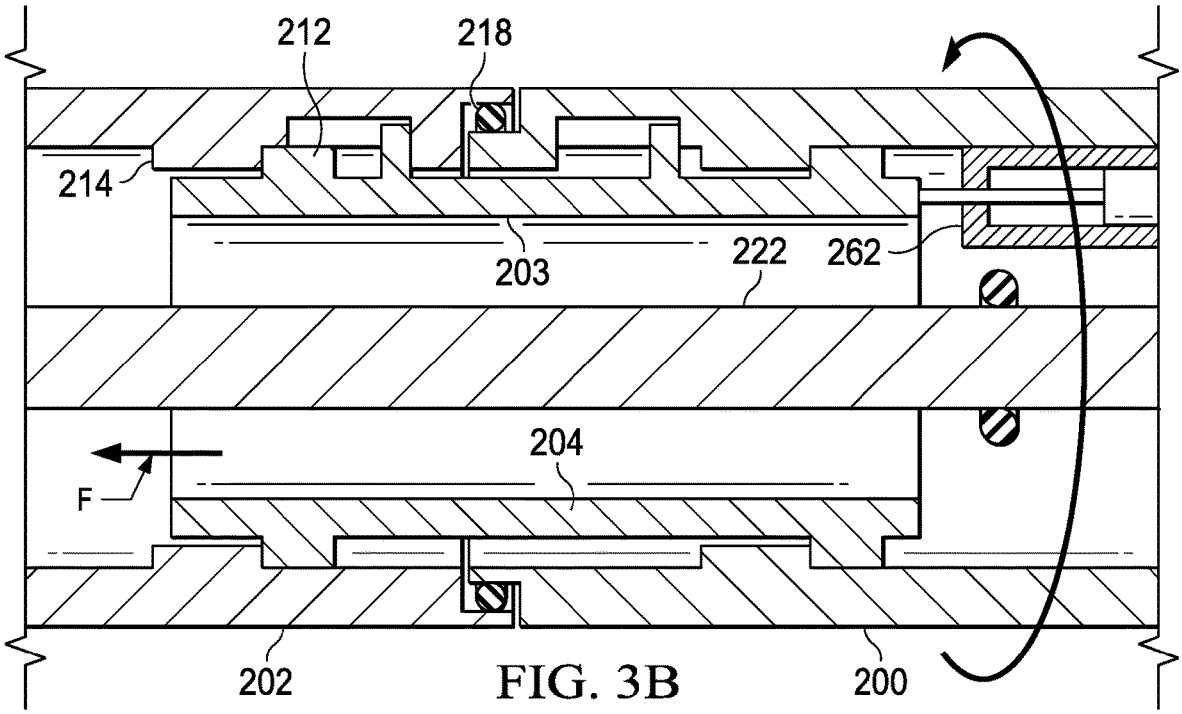
FIG. 3B is a side cross sectional view of the portion of the transmission sub of FIG. 2, with the clutch sleeve disengaged.

FIGS. 3A and 3B show the motion of the clutch sleeve 203 in engaging and disengaging the first tube 200 and the second tube 202. The sleeve 203 has a first outwardly projecting shoulder 300 and a second outwardly projecting shoulder 302. Each shoulder 300 and 302 is disposed in respective internal grooves 320 and 304 (for example, annular grooves) of the first tube 200 and the second tube 202. FIG. 3A shows the sleeve 203 engaged with the first tube 200 and the second tube 202. The downhole teeth 212 of the sleeve 203 are engaged with the teeth 214 of the second tube 202 and the uphole teeth 213 of the sleeve 203 are engaged with the teeth 215 of the first tube 200. The arrangement shown in FIG. 3A is used during rotary drilling. FIG. 3B shows the sleeve 203 disengaged from the second tube 202 (and optionally from the first tube 200). The actuator system 262 retracts the sleeve 203 to disengage the downhole teeth 212 of the sleeve 203 from the teeth 214 of the second tube 202. The first shoulder 300 of the sleeve 203 and the second shoulder 302 of the sleeve 203 engage the respective grooves 320 and 304 such that pulling the first tube 200 applies an axial load (and a shear load) to the shoulders 300 and 302 and the grooves 320 and 304 to help prevent applying the axial load on the bearings 218.

The bearings 218 can be disposed between a reduced outer diameter of the first tube 200 and an inner diameter of the second tube 202. The bearing 218 can take tensional and shear forces. Seals (not shown) such as labyrinth seals between the first tube 200 and the second tube 202 can be used to prevent fluid from leaving the transmission sub 106.

Figure 4:
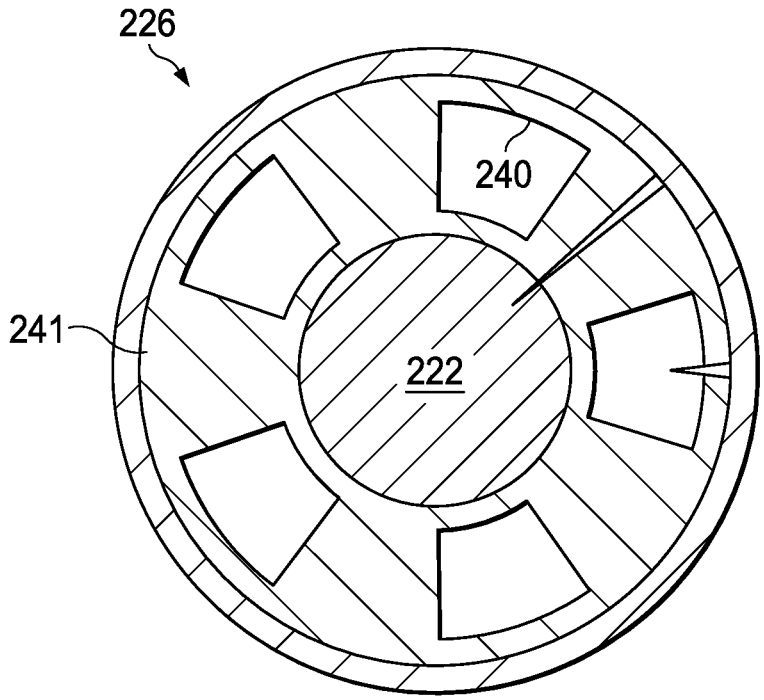
FIG. 4 is a front schematic view, partially cross sectional, of a portion of the transmission sub of FIG. 2.

FIG. 4 shows a front view of the valve system 226 according to an implementation of the present disclosure. For example, instead of using a two-valve system as shown in FIG. 2, the valve system 226 can include an annular valve with a disk or plate 241 with holes 240 or openings that act as gates to open or close a fluid pathway. The disk 241 can rotate about its central axis to align the holes 240 with holes of a fixed surface (for example, a fixed disk or plate) that guides the fluid through the holes 240. With the holes aligned, the valve is fully open. The valve is closed when the holes 240 are aligned with blanks of the fixed surface. The disk 241 is attached to or near the mud motor 222 to direct fluid to the mud motor 222. The disk 241 rotates to create a differential fluidic pressure that moves or rotates the mud motor 222. The disk 241 can change the flow (choke) to achieve desired differential pressure and motor rotation. The processor 280 can use the data gathered by the multiple sensors 228 (see FIG. 2) to determine rotations and a change of the toolface, to adjust the disk 241 to correct the toolface.

Figure 5:
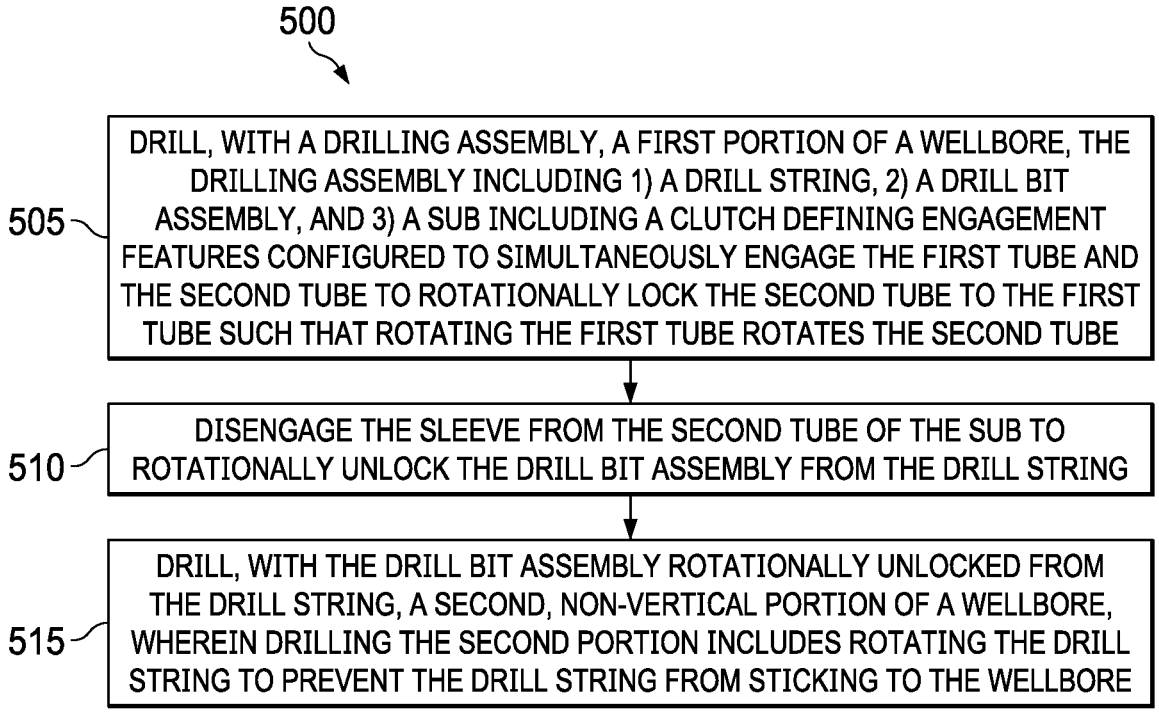
FIG. 5 is a flow chart of an example method of directional drilling.

FIG. 5 shows a flow chart of a method 500 of directional drilling. The method includes drilling, with a drilling assembly, a first portion of a wellbore, the drilling assembly including 1) a drill string, 2) a drill bit assembly, and 3) a sub including a clutch defining engagement features configured to simultaneously engage the first tube and the second tube to rotationally lock the second tube to the first tube such that rotating the first tube rotates the second tube (505). The method also includes disengaging the sleeve from the second tube of the sub to rotationally unlock the drill bit assembly from the drill string (510). The method also includes drilling (for example, 'slide drilling'), with the drill bit assembly rotationally unlocked from the drill string, a second, non-vertical portion of a wellbore. Drilling the second portion includes rotating the drill string to prevent the drill string from sticking in or to the wellbore (515).

Although the following detailed description contains many specific details for purposes of illustration, it is understood that one of ordinary skill in the art will appreciate that many examples, variations and alterations to the following details are within the scope and spirit of the disclosure. Accordingly, the exemplary implementations described in the present disclosure and provided in the appended figures are set forth without any loss of generality, and without imposing limitations on the claimed implementations.

Although the present implementations have been described in detail, it should be understood that various changes, substitutions, and alterations can be made hereupon without departing from the principle and scope of the disclosure. Accordingly, the scope of the present disclosure should be determined by the following claims and their appropriate legal equivalents.

The singular forms "a", "an" and "the" include plural referents, unless the context clearly dictates otherwise.

As used in the present disclosure and in the appended claims, the words "comprise," "has," and "include" and all grammatical variations thereof are each intended to have an open, non-limiting meaning that does not exclude additional elements or steps.

As used in the present disclosure, terms such as "first" and "second" are arbitrarily assigned and are merely intended to differentiate between two or more components of an apparatus. It is to be understood that the words "first" and "second" serve no other purpose and are not part of the name or description of the component, nor do they necessarily define a relative location or position of the component. Furthermore, it is to be understood that that the mere use of the term "first" and "second" does not require that there be any "third" component, although that possibility is contemplated under the scope of the present disclosure.

What is claimed is:

1. A drilling assembly comprising:

a drill string configured to be disposed in a wellbore;

a drill bit assembly coupled to a downhole end of the drill string; and a transmission sub coupled to and disposed between the drill bit assembly and at least a portion of the drill string, the transmission sub comprising:

a first tube attached to the drill string and comprising first mechanical engagement features;

a second tube rotationally coupled to a downhole end of the first tube, the second tube fluidically coupled to the first tube, the second tube comprising a downhole end attached to one of 1) the drill bit assembly or 2) a section of the drill string attached to the drill bit assembly, the second tube comprising second mechanical engagement features; and a clutch assembly coupled to the first tube and comprising mechanical engagement features configured to simultaneously engage the first mechanical engagement features of the first tube and the second mechanical engagement features of the second tube to rotationally lock the first tube to the second tube such that rotating the first tube rotates the second tube, at least a portion of the clutch assembly configured to move along a longitudinal axis of the first tube to disengage the second mechanical engagement features of the second tube to rotationally unlock the first tube from the second tube, wherein the first tube is rotationally coupled, through bearings, to the second tube, and wherein the transmission sub defines a fluid pathway extending from the first tube to the second tube across the bearings, and wherein the clutch assembly is coupled to the first tube and wherein one of the clutch assembly and the second tube comprises a shoulder and the other of the clutch assembly and the second tube comprises a groove configured to receive and engage the shoulder such that pulling the first tube in an uphole direction applies an axial load on the shoulder and the groove to help prevent applying the axial load on the bearings.

2. The drilling assembly of claim 1, wherein the clutch assembly comprises a sleeve configured to be disposed inside at least a portion of the first tube, the sleeve movable in a direction parallel to the longitudinal axis to engage or disengage the second mechanical engagement features of the second tube.

3. The drilling assembly of claim 2, wherein the clutch assembly further comprises an actuator system operationally coupled to the sleeve and configured to move, based on information sensed by sensors of the transmission sub, the sleeve to engage or disengage the second mechanical engagement features of the second tube.

4. The drilling assembly of claim 2, wherein the mechanical engagement features of the clutch assembly comprise two sets of outwardly projecting teeth extending from an outer surface of the sleeve and the first mechanical engagement features of the first tube and the second mechanical engagement features of the second tube comprise inwardly projecting teeth, the two sets of teeth of the sleeve configured to simultaneously engage the teeth of the first tube and the teeth of the second tube to prevent rotation of the second tube with respect to the first tube.

5. The drilling assembly of claim 4, wherein the clutch assembly further comprises a cam guide configured to rotate the sleeve to align the teeth of the sleeve with gaps between the teeth of the first tube and teeth of the second tube to help the sleeve engage the first tube and second tube.

6. The drilling assembly of claim 1, wherein the drill bit assembly comprises a bent motor and a drill bit axially coupled to and configured to be driven by the bent motor, the bent motor configured to be actuated by hydraulic power from a drilling fluid flown, by the drill string, through the transmission sub, to the drill bit assembly.

7. The drilling assembly of claim 1, wherein the drill string is configured to transmit, during directional drilling, string weight, through the bearings, to the drill bit assembly as the drill string is rotated independently from the drill bit assembly to prevent the drill string from sticking to the wellbore.

8. The drilling assembly of claim 1, wherein the transmission sub further comprises a plurality of sensors configured to sense information representing parameters including at least one of a position of the transmission sub, revolutions per minute of the first tube and the second tube, azimuth of the drill bit assembly, and toolface direction of the drill bit assembly, the plurality of sensors communicatively coupled to a processor communicatively coupled to the clutch assembly, the processor configured to control, based on information received from the plurality of sensors, the clutch assembly and other components of the transmission sub.

9. The drilling assembly of claim 1, wherein the transmission sub further comprises a rotary assembly at least partially disposed inside the first tube and the second tube and configured to keep a toolface of the drill bit assembly stationary.

10. The drilling assembly of claim 9, wherein the rotary assembly comprises a mud motor comprising a shaft fixed to the second tube and rotationally coupled to the first tube, the shaft configured to rotate, based on information sensed by sensors of the transmission sub, the second tube to keep the toolface of the drill bit assembly stationary.

11. The drilling assembly of claim 10, wherein the shaft is further configured to rotate, based on the information sensed by the sensors, the second tube to counter a reactive torque applied to a drill bit of the drill bit assembly during directional drilling.

12. The drilling assembly of claim 11, wherein the rotary assembly further comprising a valve system configured to control a flow of drilling fluid to the mud motor and to the drill bit assembly, the valve system configured to open or close, based on information sensed by the sensors of the transmission sub, a fluid pathway to rotate the mud motor.

13. The drilling assembly of claim 1, wherein the drilling assembly further comprises a measuring-while-drilling (MWD) system communicatively coupled to the transmission sub, the MWD system configured to control the transmission sub based on readings received by the MWD system from sensors of the transmission sub.

14. A drilling sub comprising:

a first tube configured to be attached to a drill string configured to be disposed in a wellbore;

a second tube rotationally coupled to a downhole end of the first tube and fluidically coupled to the first tube, the second tube comprising a downhole end configured to be coupled to a drill bit assembly disposed at a downhole end of the drill string;

a clutch assembly comprising engagement features configured to simultaneously engage the first tube and the second tube to rotationally lock the first tube to the second tube such that rotating the first tube rotates the second tube, the clutch assembly configured to move along a longitudinal axis of the first tube to disengage the second tube to rotationally unlock the first tube from the second tube; and a rotary assembly at least partially disposed inside the first tube and the second tube and configured to keep a toolface of the drill bit assembly stationary, wherein the rotary assembly comprises a mud motor comprising a shaft fixed to the second tube and rotationally coupled to the first tube, the shaft configured to rotate, based on information sensed by sensors of the transmission sub, the second tube to keep the toolface of the drill bit assembly stationary.

15. The drilling sub of claim 14, wherein the clutch assembly comprises a sleeve configured to be disposed inside at least a portion of the first tube, the sleeve comprising mechanical engagement features and movable along an interior surface of the first tube in a direction parallel to the longitudinal axis to engage or disengage mechanical engagement features of the first tube and second tube.

16. The drilling sub of claim 14, wherein the clutch assembly is configured to allow, with the clutch assembly engaged, rotary drilling with the drill string and the drill bit assembly rotating simultaneously, and wherein the clutch assembly is configured to allow, with the clutch assembly disengaged, slide drilling with the drill string transmitting string weight to the drill bit assembly through the drilling sub as the drill string is rotated independently from the drill bit assembly, to prevent the drill string from sticking to the wellbore.

17. A method of directional drilling, the method comprising:

drilling, with a drilling assembly, a first portion of a wellbore, the drilling assembly comprising 1) a drill string, 2) a drill bit assembly coupled to and residing at a downhole end of the drill string, and 3) a sub coupled to and disposed between the drill bit assembly and at least a portion of the drill string, the sub comprising a first tube attached to the drill string, the sub comprising a second tube rotationally coupled to the first tube and comprising a downhole end coupled to the drill bit assembly, the sub comprising a clutch assembly defining engagement features configured to simultaneously engage the first tube and the second tube to rotationally lock the second tube to the first tube such that rotating the first tube rotates the second tube, the clutch assembly configured to move along a longitudinal axis of the first tube and second tube to disengage the second tube to rotationally unlock the first tube from the second tube, wherein drilling the first portion of the wellbore comprises drilling the first portion with the clutch assembly engaged to the first and second tubes such that rotating the drill string rotates the drill bit assembly;

disengaging the clutch assembly from the second tube of the sub to rotationally unlock the drill bit assembly from the drill string; and drilling, with the drill bit assembly rotationally unlocked from the drill string, a second, non-vertical portion of the wellbore, wherein drilling the second portion of the wellbore comprises rotating the drill string to prevent the drill string from sticking to the wellbore, wherein the sub comprises a rotary assembly at least partially disposed inside the first tube and the second tube, wherein the rotary assembly comprises a mud motor comprising a shaft fixed to the second tube and rotationally coupled to the first tube, wherein the method further comprises:

rotating the shaft based on information sensed by sensors of the sub; and keeping a toolface of the drill bit assembly stationary.

18. The method of claim 17, wherein disengaging the clutch assembly from the second tube comprises actuating an actuator system of the clutch assembly to move a sleeve of the clutch assembly in an uphole direction parallel to the longitudinal axis of the first tube.

* * * * *